US008341774B1

(12) United States Patent
Norris

(10) Patent No.: US 8,341,774 B1
(45) Date of Patent: Jan. 1, 2013

(54) VERTICALLY SLIDING ENCLOSURE CONTAINING THREE-SLIDABLE GLASS PANEL ASSEMBLIES FOR BATHTUB/SHOWER COMBINATIONS

(76) Inventor: Roy Norris, Los Angeles, CA (US)

( * ) Notice: Subject to any disclaimer, the term of this patent is extended or adjusted under 35 U.S.C. 154(b) by 0 days.

(21) Appl. No.: 13/292,952

(22) Filed: Nov. 9, 2011

Related U.S. Application Data

(60) Provisional application No. 61/456,789, filed on Nov. 12, 2010.

(51) Int. Cl.
*A47K 3/08* (2006.01)

(52) U.S. Cl. ..... 4/557; 4/601; 4/608; 4/607; 4/558

(58) Field of Classification Search ..... 4/608, 607, 4/557

See application file for complete search history.

(56) References Cited

U.S. PATENT DOCUMENTS 2,929,074 A * 3/1960 Spector ..... 4/557
3,896,508 A * 7/1975 Doan ..... 4/557
3,955,239 A * 5/1976 Grossman ..... 16/96 R
4,293,154 A * 10/1981 Cassells ..... 292/144
6,023,794 A * 2/2000 Nein ..... 4/607

* cited by examiner

*Primary Examiner* — Gregory Huson
*Assistant Examiner* — Lauren Heitzer
(74) *Attorney, Agent, or Firm* — Thomas I. Rozsa

(57) ABSTRACT

A vertical sliding enclosure for a bathtub, including three vertically slidable glass panel assemblies, wherein each assembly contains a slidable glass panel attached by the left and right glass connectors serving as the transverse position limiters which limit the panel in the transverse movement, a pair of left and right housings having the respective longitudinal tracks for the panel in the vertical movement, and room for a counterbalancing weight system containing left and right pulleys and weight combination so that a weight of the glass panel can be balanced. The enclosure provides a sufficient height for a user to access the bathtub when the three panels are raised to their maximum heights. When in their lowered position, the three panels prevent shower water from entering the bathroom floor.

23 Claims, 9 Drawing Sheets

VERTICALLY SLIDING ENCLOSURE CONTAINING THREE-SLIDABLE GLASS PANEL ASSEMBLIES FOR BATHTUB/SHOWER COMBINATIONS

This patent application claims priority to Patent Application Ser. No. 61/456,789 filed on Nov. 12, 2010.

BACKGROUND OF THE INVENTION

1. Field of the Invention

The present invention is related to the field of enclosures for bathtub/shower combinations which enable the bathtub/shower to be enclosed so that when a person takes a shower, water will not flow onto the bathroom floor.

2. Description of the Prior Art

Bathtub closures are known in the market of consumer products. U.S. Pat. No. 3,955,239 discloses a bathtub closure means including two identical rectangular panels, wherein the longitudinal sides of each panel are aligned in a horizontal direction, and the transverse sides of the panel are aligned in a vertical direction. The panels are vertically slidable and counterbalanced, so that the panels can be moved to an elevated position to permit a person to enter the bathtub and then retracted to a lowered position to enable a person to take a shower. This product could not support heavy glass and could only support aluminum framed lightweight acrylic panels.

However, a major setback of the design in U.S. Pat. No. 3,955,239 is that it does not enable the panels to be raised to a height which is sufficient to make the users feel comfortable to enter and exit the bathtub when the two panels are raised to their maximum allowed heights. Such restricted access inhibits a feeling of openness while entering and exiting the bathtub.

Therefore, there is a significant need to provide an enclosure having improved mechanisms including the vertically slidable panels and counterbalanced devices to significantly improve the function of the enclosure, thereby providing sufficient open height to enable a user to easily enter and exit the bathtub.

SUMMARY OF THE INVENTION

The present invention is a vertically sliding enclosure, which is installed onto a top of the bathtub ledge. The enclosure includes first or front, second or middle and third or rear vertically slidable glass panel assemblies which have the respective first or front, second or middle and third or rear slidable glass panels. The enclosure provides a sufficient height of an open space over the top of the bathtub ledge for a user to easily enter and exit the bathtub when the three panels are raised to their maximum heights.

Bathtub/Shower combinations are installed in homes and apartments to enable both bathing and showering. An enclosure is provided to prevent splashing of water outside of the bathtub during showering. These enclosures are commonly either shower curtains or are constructed with two horizontally-sliding panels.

Although shower curtains may be fully drawn to the side to allow nearly unrestricted access to the bathtub, they are neither sturdy nor permanent and are not aesthetically pleasing, particularly as they age.

Enclosures consisting of two horizontally-sliding panels are sturdy and permanent, but allow less than 50% access to the bathtub. The restricted access inhibits a feeling of openness while bathing. The horizontally-sliding panels are guided by top and bottom metal channels. The upward-protruding metal channel on top of the, bathtub ledge, along with the restricted access, make bathing of children, cleaning of the bathtub, and entering and exiting the bathtub difficult and uncomfortable.

The present invention provides a vertically sliding enclosure for bathtub/shower combinations consisting of first, second and third vertically slidable glass panel assemblies which have the respective first, second and third vertically slidable glass panels positioned in the respective left-right transverse direction, wherein each rectangularly shaped glass panel includes attachments that are the upper and lower lengthwise handles, left upper and lower glass connectors, and right upper and lower glass connectors. Each assembly embodies a counterbalancing weight system to balance a weight of the glass panel attached by the attachments to thereby allow smooth, coordinated movement of the panel up and down to a fixed and steady position. This enclosure is sturdy and permanent and allows unrestricted and comfortable access to the bathtub in its fully-open condition when each of the three panels is lifted to its maximally allowed high position.

Each counterbalancing weight system consists of a left counterbalancing weight connected to a left cable which passes a top of a left pulley penetrated by a left collar to thereby be capable of connecting to the left upper glass connector, and a right counterbalancing weight connected to a right cable which passes a top of a right pulley penetrated by a right collar to thereby be capable of connecting to the right upper glass connector.

Each assembly also includes left and right housings. The left housing has a rightward open-ended gap whose two elongated edges are covered by left front and rear flexible trims (selected from the group consisting of vinyl, nylon and rubber), wherein the two trims serve as the tracks having a rightwardly extending longitudinal air gap in between together for the glass panel to be vertically moved. The right housing has a leftward open-ended gap whose two elongated edges are covered by the respective right front and rear flexible trims (selected from the group consisting of vinyl, nylon and rubber), wherein the two trims serve as the tracks having a leftwardly extending longitudinal air gap in between to enable the same glass panel to be the vertically moved.

Each left housing is used for positioning the left counterbalancing weight, cable, pulley penetrated by the left collar and a left transverse side of the glass panel attached by the left upper and lower glass connectors, wherein the glass panel penetrates through the rightward longitudinal air gap of the housing to extend in a rightward direction. Each right housing is for positioning the right counterbalancing weight, cable, pulley penetrated by the right collar and a right transverse side of the glass panel attached by the right upper and lower glass connectors, wherein the glass panel penetrates through the leftward longitudinal air gap of the housing to extend in a leftward direction. Therefore, the left and right tracks formed by the respective front and rear flexible trims (selected from the group consisting of vinyl, nylon and rubber), of the respective left and right housings prevent the glass panel from having a forward or backward movement when the glass panel is vertically slid up or down, in addition to providing a smooth movement for the glass panel in the vertical direction.

The enclosure also includes the left and right pulley axles. In assembling the enclosure, the left pullet axle penetrates through a top of the first left housing of the first assembly and a center of the first left collar surrounded by the first left pulley positioned inside of the first left housing, a top of the second left housing of the second assembly and a center of the second left collar surrounded by the second left pulley positioned inside of the second left housing, and a top of the third left housing of the third assembly and a center of the third left collar surrounded by the third left pulley positioned inside of the third left housing, wherein the first, second and third left housing are aligned in a series and attached to one another so that their respective rightward longitudinal air gaps are aligned in a forward direction.

The right pullet axle penetrates through a top of the first right housing of the first assembly and a center of the first right collar surrounded by the first right pulley positioned inside of the first right housing, a top of the second right housing of the second assembly and a center of the second right collar surrounded by the second right pulley positioned inside of the second right housing, and a top of the third right housing of the third assembly and a center of the third right collar surrounded by the third right pulley positioned inside of the third right housing, wherein the first, second and third right housings are aligned in a series and attached to one another so that their respective leftward longitudinal air gaps are aligned in a forward direction.

Therefore in the vertical movement of each glass panel, the left upper and lower glass connectors which are attached on the left side of the glass panel and interiorly positioned adjacent to the left front and rear flexible (selected from the group consisting of vinyl and rubber) trims serve as the left transverse position limiters for preventing the glass panel's movement in a rightward direction. The right upper and lower glass connectors which are attached on the right side of the glass panel and interiorly positioned adjacent to the right front and rear flexible trims serve as the right transverse position limiters for preventing the glass panel's movement in a leftward direction. Therefore, each glass panel of the three glass panel assemblies of the present invention enclosure has a very limited movement in the left-right transverse directions while in its engaged in its vertical sliding movement under a combined effort provided by the respective left and right transverse position limiters and tracks when each of the three assemblies is completely assembled and installed to the respective left and right sidewalls of a bathroom having the bathtub.

It will be appreciated that each slidable glass panel of the vertically sliding enclosure could have a smooth, coordinated and finger-tip movement up or down which is based on the novel counterbalancing weight system incorporated with the transverse position limiters and longitudinal trucks formed by two elongated flexible trims (selected from the group consisting of vinyl, nylon and rubber) of the present invention.

The enclosure further has an elongated lengthwise flexible member positioned on a bottom of the lower transverse handle of the first glass panel which provides a watertight seal in showering when the first glass panel is slid down to be in contact with the top of the bathtub ledge.

It will be appreciated that the fully-open condition of the enclosure could be reached when the three slidable glass panels are raised to their respective maximum heights, wherein the top and bottom of the lower lengthwise handle of the second panel are respectively horizontally aligned with the bottom of the lower lengthwise handle of the third panel, and the top of the lower lengthwise handle of the first panel. In that situation, a top of the upper handle of the third glass panel is in contact with a ceiling of the bathroom, and a bottom of the lengthwise rubber member of the first glass panel is positioned to a top of a safety lock, wherein the safety lock is positioned to engage a safety lock hole that penetrates through the right side of the front right housing and is in a plane in a rightward direction to pass the leftward longitudinal air gap of the housing.

It will be further appreciated that a fully closed position also could be reached according to a maximum height that the three slidable glass panels can block while in their respective lowered positions, wherein the bottom of the lengthwise flexible member of the first panel is in contact with the top of the bathtub ledge, a top of the upper lengthwise handle of the first glass panel is horizontally aligned with the bottom of the lower lengthwise handle of the second glass panel. At a same time a top of the upper lengthwise handle of the second glass panel is horizontally aligned with the bottom of the lower lengthwise handle of the third glass panel. In this situation, the maximally height, which is the height of the top of the upper lengthwise handle of the third glass panel, is slightly lower than a position of the shower head positioned to the left sidewall of the bath room. Therefore, the present invention enclosure in such extended condition is sufficient to prevent splashing of water out of the bathtub.

It will be additionally appreciated that the present invention enclosure also allows any positions in between the fully opened and closed positions.

The vertically slidable panels are constructed with code-compliant tempered glass. In addition to the sturdiness provided by the use of glass, aesthetically-pleasing clear or translucent glass panels can be utilized. Further the translucent plastics or clear plastics with an aesthetically-pleasing appearance can also be used. The respective housings can be made of plastics or durable metals and metal alloys.

This invention is constructed to provide a watertight enclosure while showering and is readily adapted to both new and existing homes and apartments.

In summary, the main objects and advantages of this invention are: (1) it allows for unrestricted access to the bathtub when the enclosure is in a fully-open position; (2) it includes the transverse rubber member positioned at the bottom of the first glass panel to serve as the watertight seal; (3) it is constructed with glass or plastic panels; and (4) it utilizes a novel counterbalancing weight system incorporated with the transverse position limiters and elongated longitudinal tracks which provide smooth operation of the vertically slidable panels.

Further novel features and other objects of the present invention will become apparent from the following detailed description and discussion, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
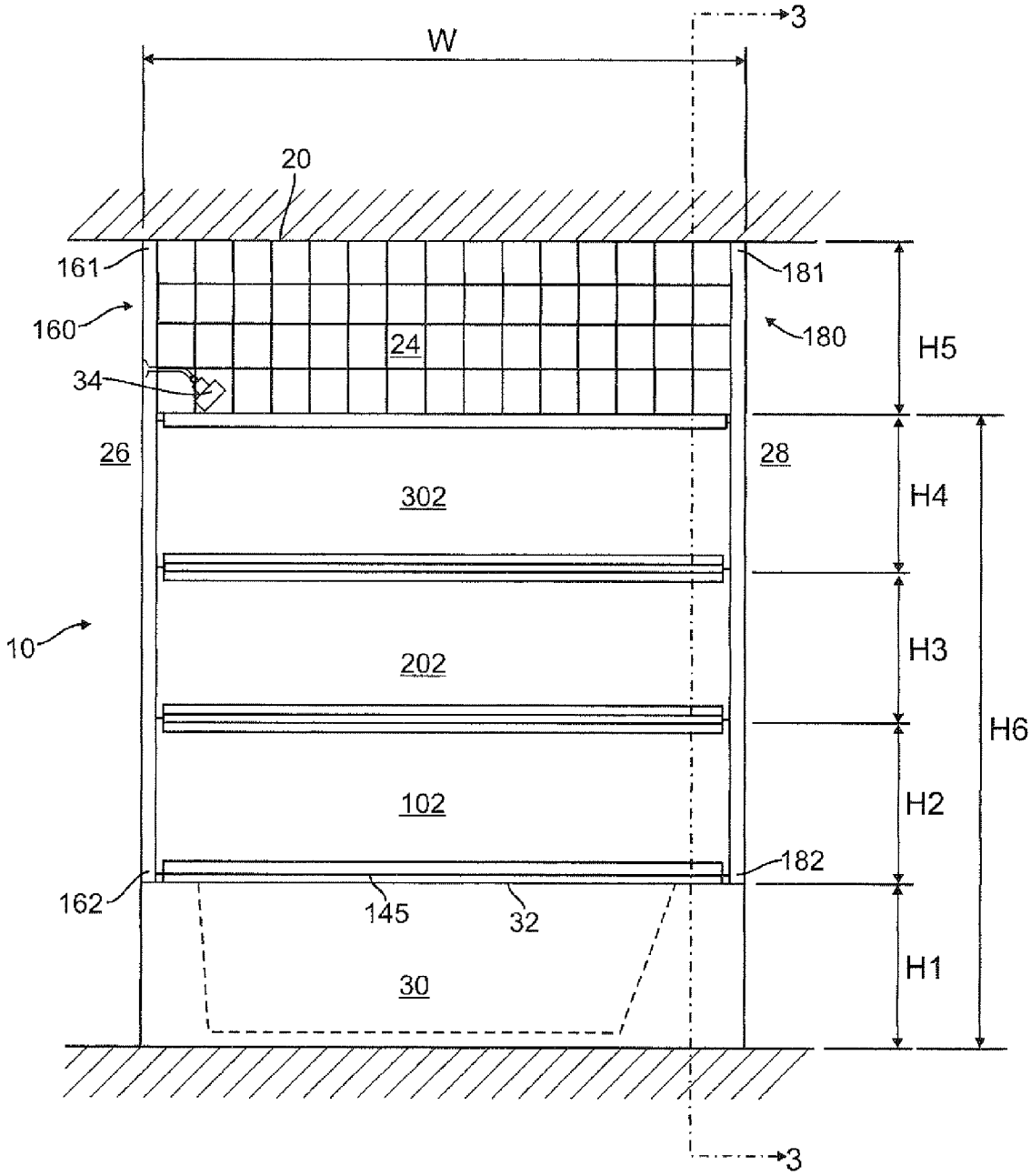
FIG. 1 is a front view of the present invention vertically sliding enclosure containing three vertically slidable panel assemblies, wherein the enclosure is in a fully closed condition, which is caused by three glass panels positioned in their respective lowered conditions so that a person can take a shower in the bathtub in addition to prevent splashing of the shower water out of the bathtub.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Referring to FIGS. 1, 2, 3 and 7, there is illustrated an embodiment 10 of the present invention vertically sliding enclosure for a bathtub 30 having a width "w" positioned in a bathroom, wherein the room has a ceiling 20, a rear wall 24, a left or first sidewall 26 and a right or second sidewall 28 to surround the bathtub. The enclosure 10 is symmetrical relative to its middle vertical line, and includes a front or first vertically slidable glass panel assembly 100 (see FIG. 7) having a front or first slidable glass panel 102 and front or first counterbalancing weight system, a middle or second vertically slidable glass panel assembly 200 (see FIG. 7) having a middle or second slidable glass panel 202 and middle or second counterbalancing weight system, and a rear or third vertically slidable glass panel assembly 300 (see FIG. 7) having a rear or third slidable glass panel 302 and rear or third counterbalancing weight system.

In a preferred embodiment of the enclosure, the three vertical slidable glass panel assemblies have the identical dimensions, wherein the panels are made of the preferred material such as a code-compliant tempered glass including an aesthetically-pleasing clear or translucent glass. However, a translucent plastic or clear plastic with aesthetically-pleasing character is also appropriate. Therefore, each assembly can be broadly defined as a vertically slidable panel assembly having a slidable panel.

Figure 4:
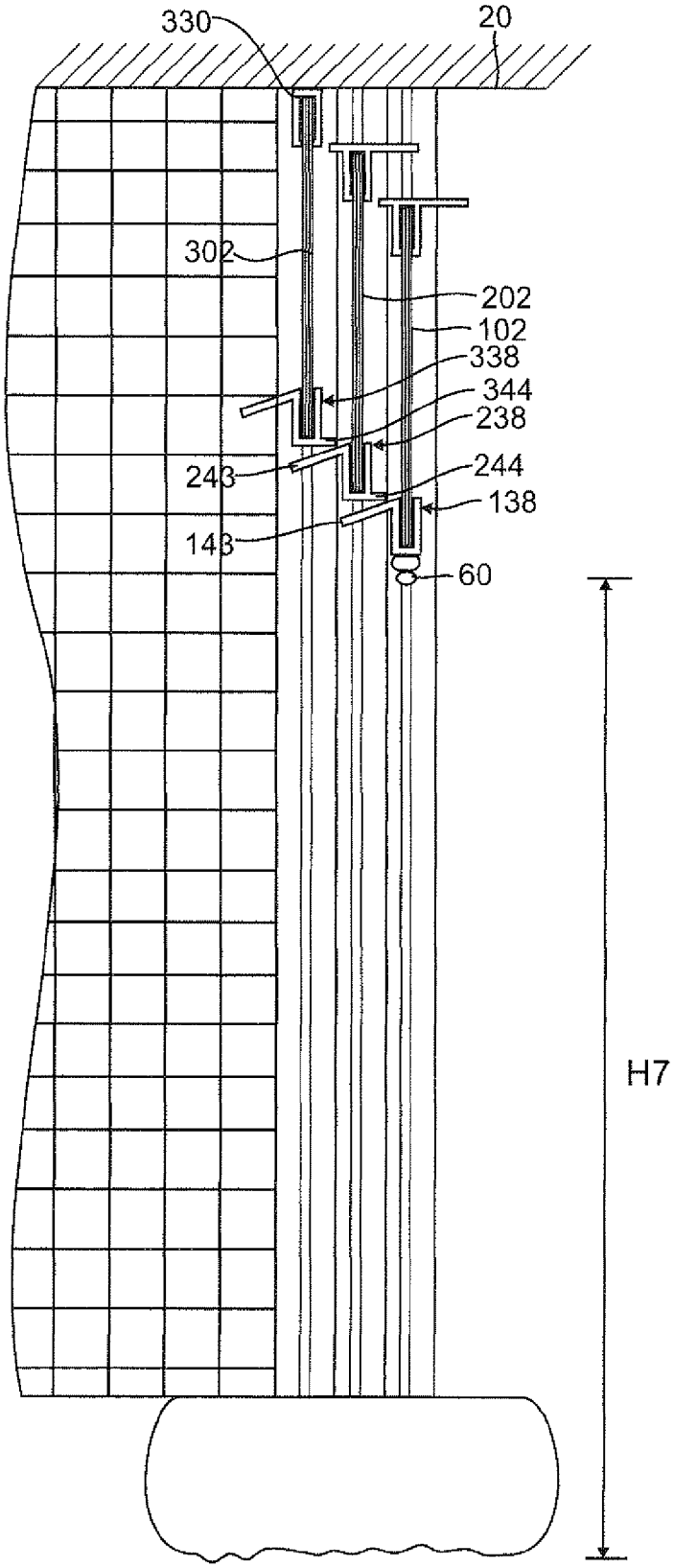
FIG. 4 is a longitudinal cross-sectional view of the vertically sliding enclosure taken along line 3-3 of FIG. 2 wherein the three panels are vertically stacked, as compared with the panels in the position illustrated in FIG. 3.
Figure 5:
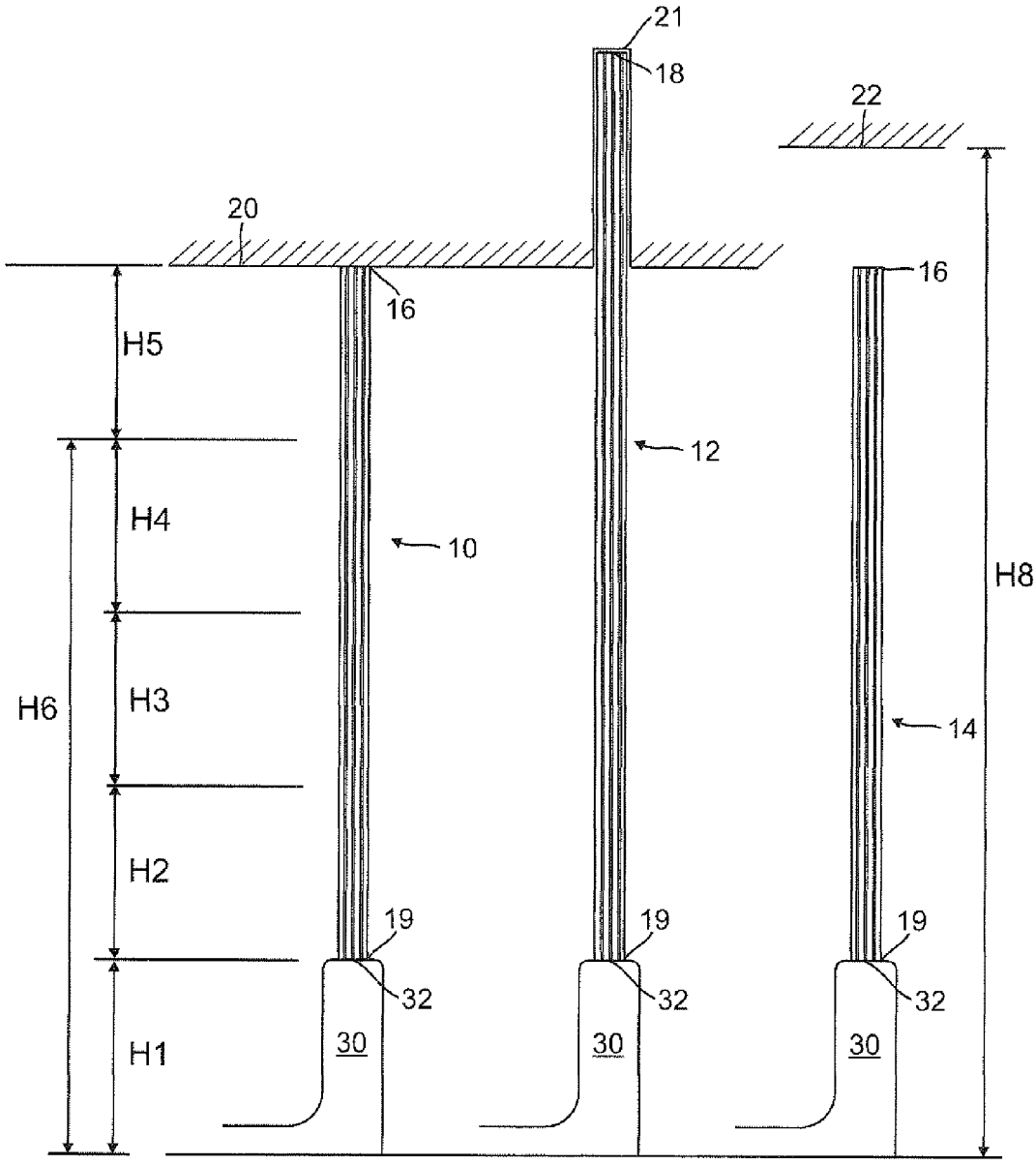
FIG. 5 is a schematic diagram in three longitudinal cross section views of the respective three embodiments of the present invention. The embodiments have the respective tops of the enclosures relative to two different ceiling heights of a bath room, wherein one view shows a structural variation of an enclosure that includes a recessed ceiling pocket for positioning the three glass panels to thereby provide an extreme height of the entrance space.

It will be appreciated that, as illustrated in FIG. 5, the present invention enclosure has three embodiments 10, 12 and 14 regarding a top of the enclosure that is positioned relative to the ceiling of a bathroom. The first embodiment 10 shows that the enclosure has a full height of the bathroom, wherein its top 16 is in contact with the ceiling 20 of the bathroom, and its bottom end 19 is in contact with a top of the bathtub ledge. This condition is also illustrated in FIGS. 1 to 4. In the second embodiment 12, there is a recessed ceiling pocket 21 so that it provides a room for all three slidable glass panels to be positioned inside of the pocket. This enables the enclosure to have a top 18, whose height is higher than that of the ceiling 20. It will be appreciated that these two embodiments 10 and 12 are designed for a ceiling having a regular height such as 8 or 9 feet. The third embodiment 14 shows that the top of the enclosure is positioned lower than a ceiling 22, which has a height "H8" that is higher than the regular ceiling height, for example, 10 feet or more.

Figure 2:
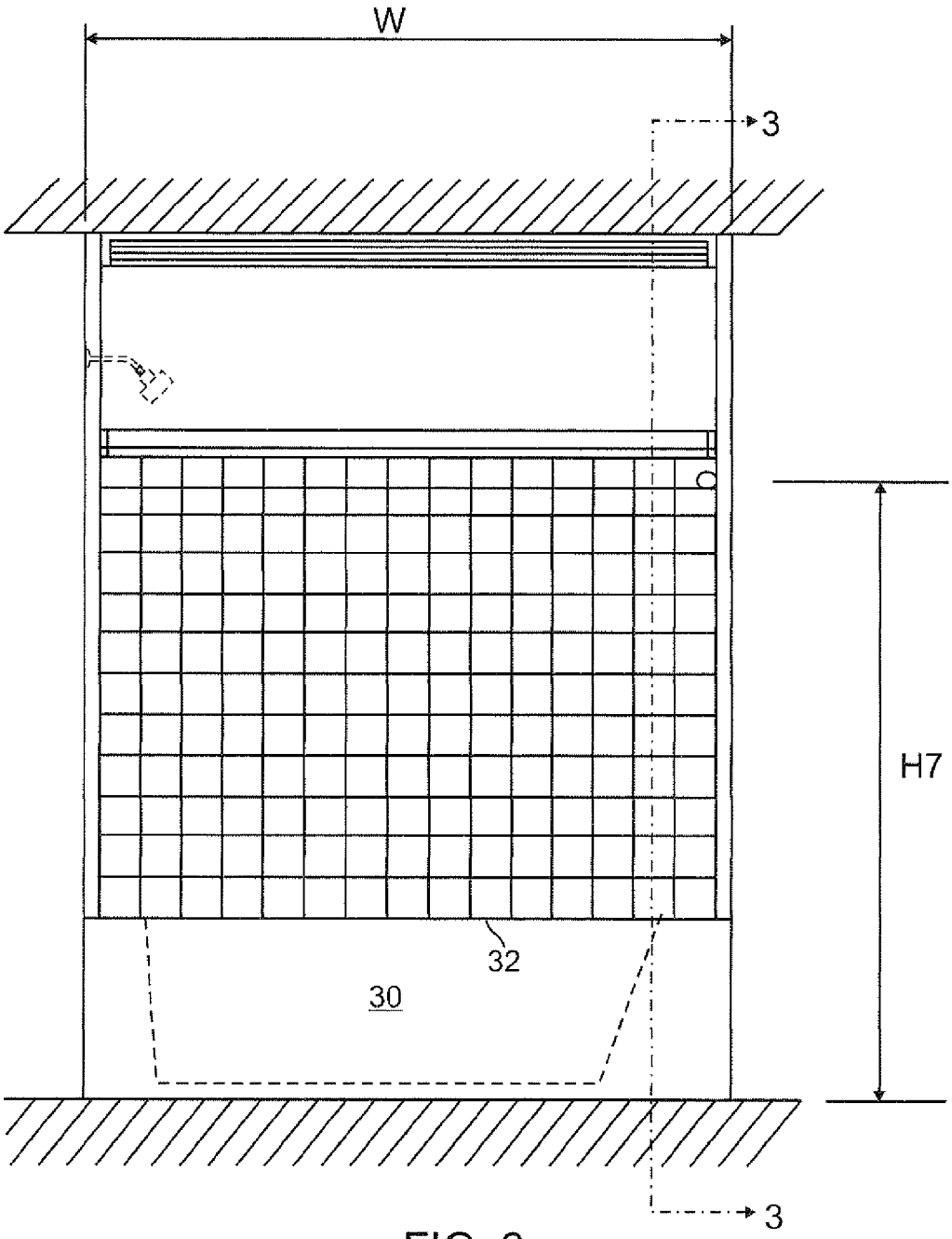
FIG. 2 is a front view of the present invention vertically sliding enclosure, wherein the enclosure is in a fully opened condition, which is caused by the three glass panels raised to their respective maximum allowed heights so that it provides an entrance space having a sufficient height to enable a user to easily enter and exit the bathtub.
Figure 3:
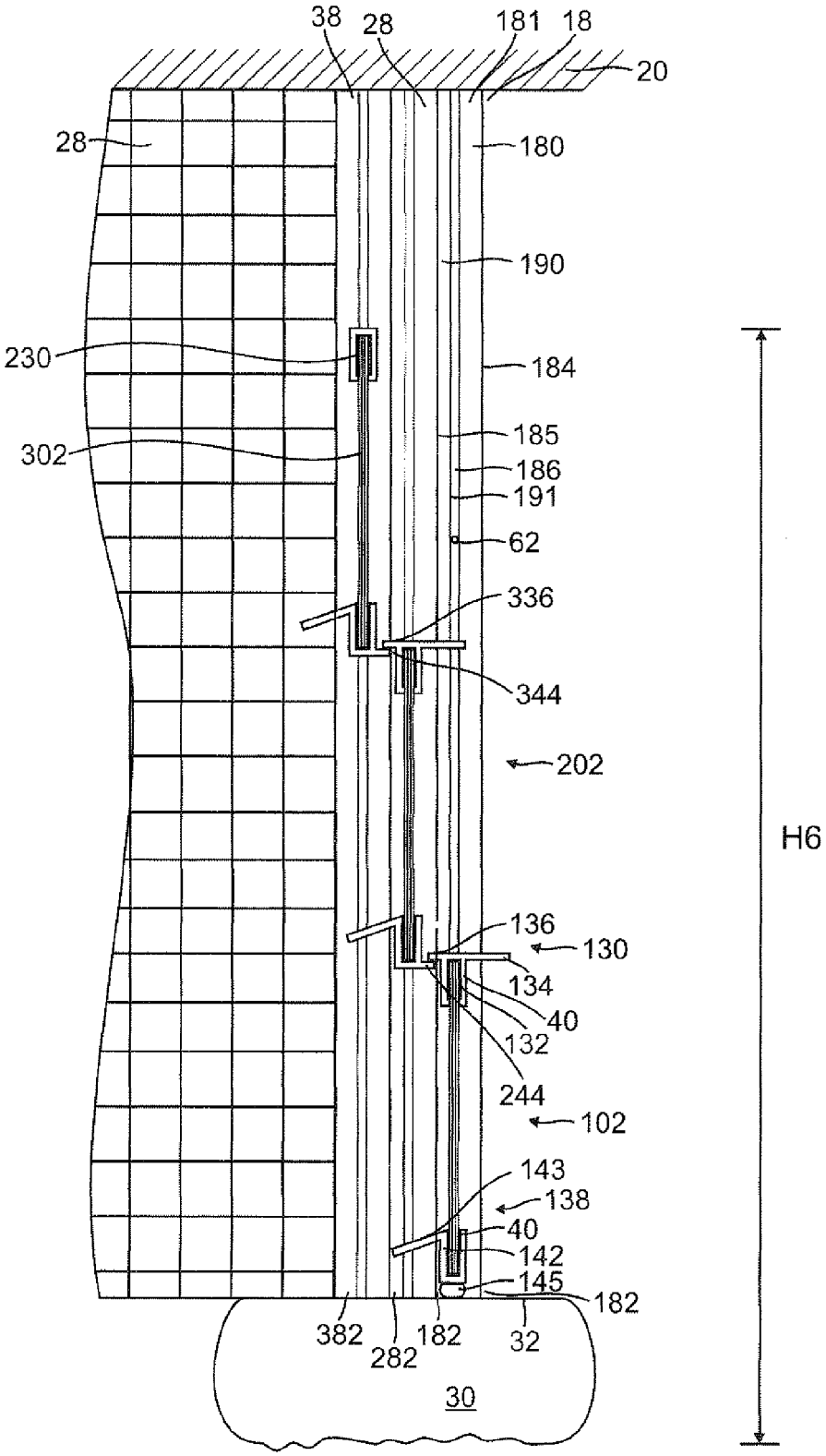
FIG. 3 is a longitudinal cross-sectional view of the vertically sliding enclosure taken along line 3-3 of FIG. 1.

As illustrated in FIGS. 1 and 3, the three glass panels 102, 202 and 302 are positioned at their respective optimum lowered positions, wherein the front glass panel 102 is in contact with a top 32 of the bathtub 30. Therefore, the three glass panels maximally block an entrance space to the bathtub, and preventing splash of the shower water out of the bathtub when a user is in a shower. As a comparison, FIGS. 2 and 4 illustrate that the three panels are raised to their respective maximum heights, which provides a sufficient height "H7" of an open space to enable the user to access the bathtub 30. Therefore, the present invention vertically sliding enclosure brings convenience for the user to access the bathtub when entering or exiting the bathtub, which is advantageous over the conventional bathtub enclosure. In the meantime, the present invention also possesses the function to seal water inside of the bathtub, which is the same as that of the conventional bathtub enclosure.

Figure 6:
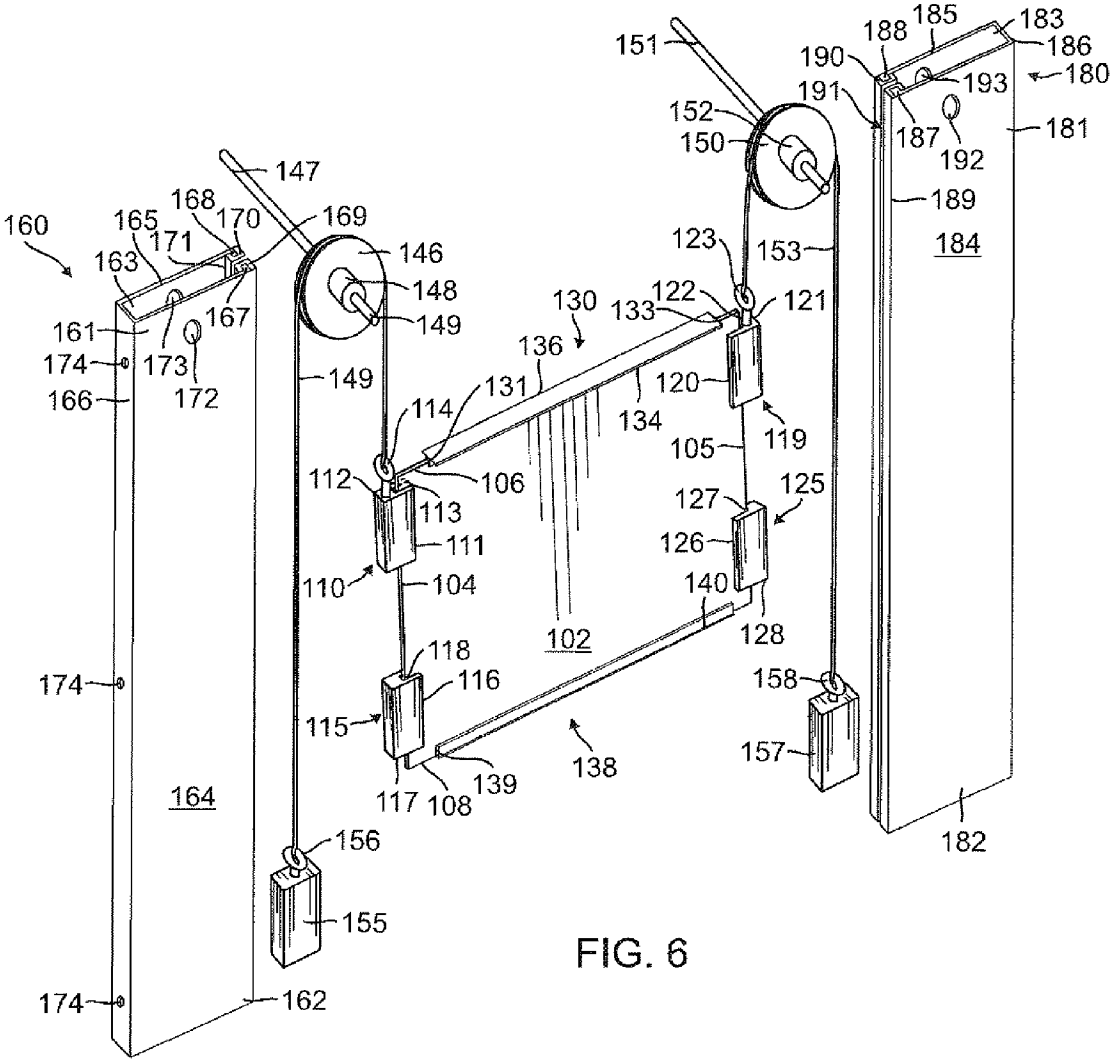
FIG. 6 is a perspective view to illustrate various parts of a first vertically slidable glass panel assembly, wherein the front left and right housings and corresponding pulley axles surrounded by the respective collars of the assembly are drawn in the exploded view.
Figure 7:
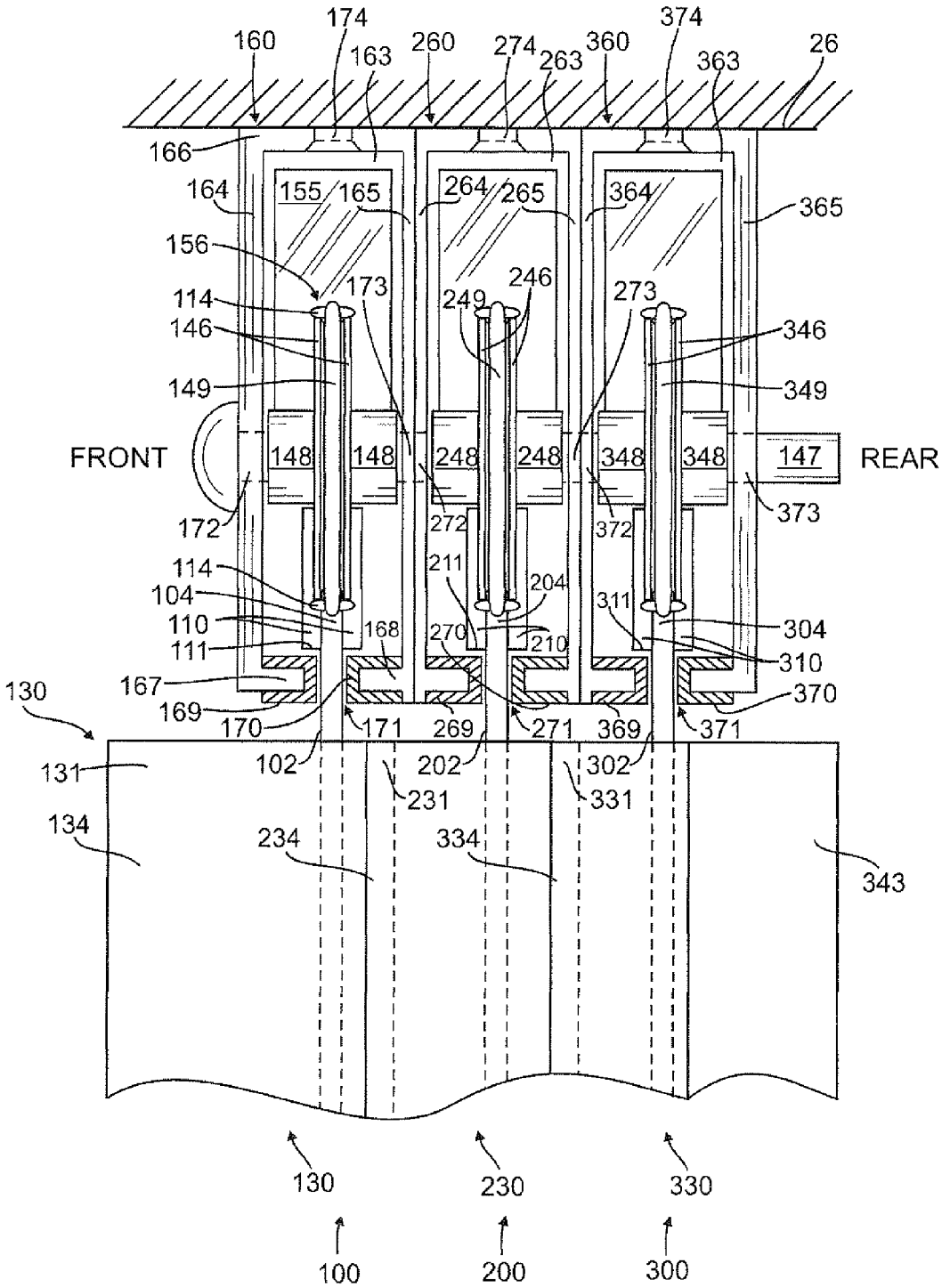
FIG. 7 is a partial top view of the present invention vertically sliding enclosure to illustrate the structural relationship of parts positioned adjacent to a left sidewall of the bathroom for each of the three vertically slidable glass panel assemblies when they are assembled.

Referring to FIGS. 6 and 7, there is illustrated structural characteristics of the first or front vertically slidable glass panel assembly 100, containing various front left parts and attachments that are symmetrical to the respective various front right parts and attachments. The assembly 100 includes the slidable glass panel 102 having front upper, lower, left and right attachments, a front left or front first housing 160 for positioning a front left pulley 146 penetrated by a front left collar 148 that it is further penetrated by a left pulley axle 147, a front left cable 149 and a front left counterbalancing weight 155. The front left cable 149 is positioned to pass a top of the pulley 146 wherein the cable at a left end is connected to a front left eye bolt 156 connected to a top of the front left counterbalancing weight 155.

The assembly 100 symmetrically has a front right or front second housing 180, which is a mirror image of the front left housing 160, for positioning a front right pulley 150 penetrated by a front right collar 152 that is further penetrated by a right pulley axle 151, a front right cable 153 and a front right counterbalancing weight 157. The front right cable 145 is positioned to pass a top of the pulley 150 wherein the front right cable at a right end is connected to a front right eye bolt 158 connected to a top of the front right counterbalancing weight 157.

The front slidable glass panel 102 is rectangular in shape, including a left or first transverse side 104, a right or second transverse side 105, an upper lengthwise side 106 connected to an upper attachment, which is a front upper transverse handle 130, and a lower lengthwise side 108 connected to a lower attachment, which is a front lower transverse handle 138. The glass panel 102 further has the left attachments, which include a front left upper glass connector 110 at its top end 112 connected to a front left eye bolt 114 and a front left lower glass connector 115, wherein the front left upper and lower glass connectors 110 and 115 are adhesively affixed to the respective upper and lower positions of the left transverse side 104 of the glass panel.

The glass panel 102 symmetrically has right attachments which are the respective mirror images of the left attachment. The right attachments include a front right upper glass connector 119 at its top 121 connected to a front right eye bolt 123 and front right lower glass connector 125, wherein the front right upper and lower glass connectors are also adhesively affixed to the respective upper and lower positions of the right or second transverse side 105 of the glass panel.

Figure 8:
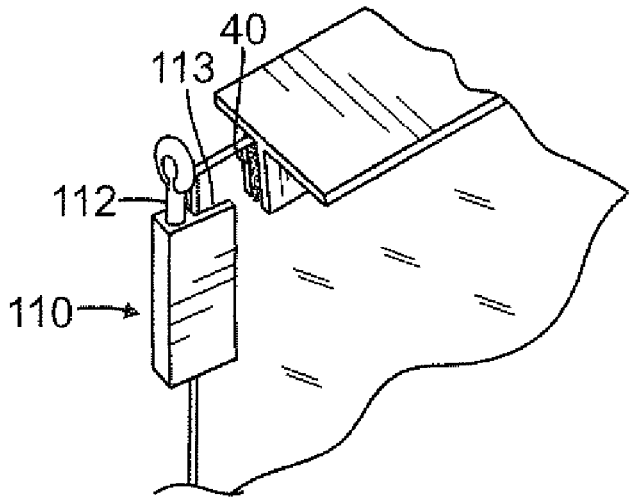
FIG. 8 is an elevational perspective view to illustrate structural characteristics of the upper left portion of a front or first glass panel of the first vertically slidable glass panel assembly.
Figure 9:
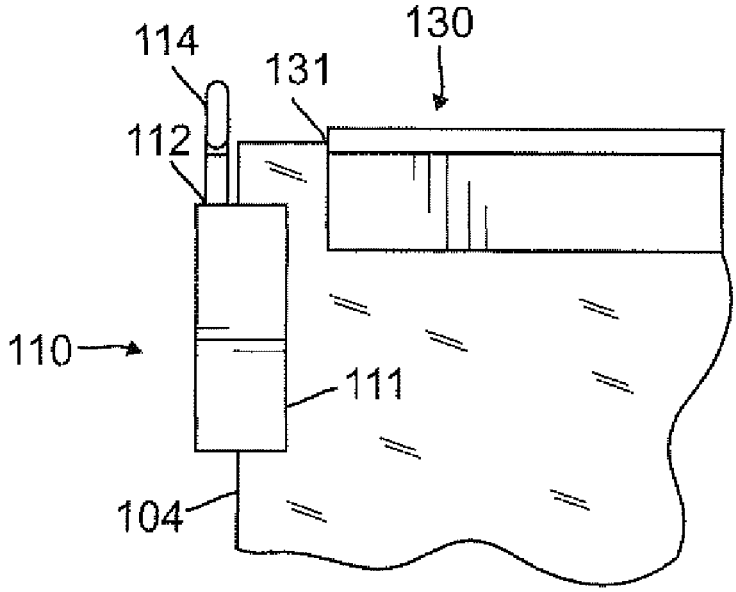
FIG. 9 is an elevational front view, as compared with the perspective view in FIG. 8.
Figure 10:
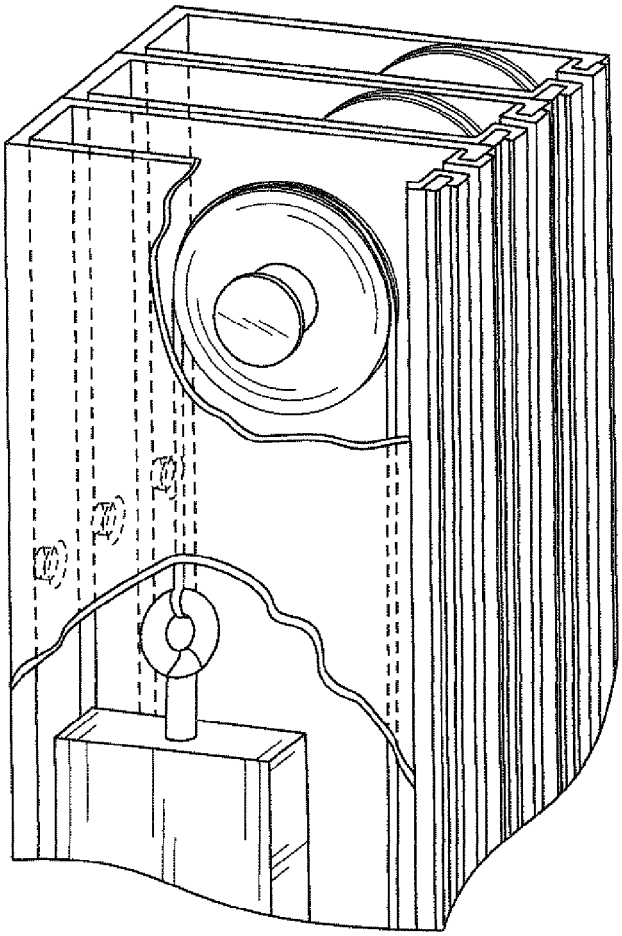
FIG. 10 is a perspective view to illustrate top portions of the assembled front, middle and rear left housings of the present invention vertically sliding enclosure, wherein a front side of the front left housing is partially cut to thereby show a front left pulley and a front left counterbalancing weight positioned inside of the housing.

The front left upper and lower glass connectors 110 and 115 are identical including their respective identical bodies. As additionally illustrated in FIGS. 8 and 9, the body of the front left upper glass connector 110 has the top end 112, a bottom end, and a "U" shaped cross section containing a rightward air channel 113 surrounded by a front side, rear side, left side and right side 111, wherein the right side 111 are completely separated by the air channel 113. The front left upper glass connector 110 is attached to an upper position of the left or first transverse side 104 of the glass panel 102, wherein the glass panel is inserted into and further adhered by adhesives 40 (see FIG. 8) to the rightward air channel 113. This results in the top end 112 of the left upper glass connector 110 is positioned lower than the upper lengthwise side 106 of the glass panel.

The body of the front left lower glass connector 115 has a top end, a bottom end 117, and a "U" shaped cross section containing a rightward air channel 118 surrounded by a front side, rear side, left side, and right side 116, wherein the right side 116 are completely separated by the air channel 118. The front left lower glass connector is attached to a lower position of the left transverse side 104 of the glass panel, so that its right side 116 is vertically aligned with the right side 111 of the left upper glass connector 110, and its bottom end 117 is positioned higher than the lower lengthwise side 108 of the glass panel. Therefore in this setting, it will be appreciated that the left upper and lower glass connectors 110 and 115 serve as the respective upper and lower transverse position limiters in cooperation with the front left housing 160 to prevent a movement of the glass panel in a rightward transverse direction when sliding the glass panel 102 in the vertical direction.

The front right upper and lower glass connectors 119 and 125 are attached to the right or second transverse side 105 of the glass panel as the mirror images of the respective front left upper and lower glass connectors 110 and 115. The front right upper and lower glass connectors 119 and 125 are identical including their respective identical bodies. The body of the front right upper glass connector 119 has the top end 121, a bottom end a "U" shaped cross section containing a leftward air channel 122 surrounded by a front side, rear side, right side and left side 120, wherein the left side is completely separated by the air channel. The body of the front right lower glass connector 125 has a top end, a bottom end 128, and a "U" shaped cross section containing a leftward air channel 127 surrounded by a front side, rear side, right side and left side 126, wherein the left side is completely separated by the air channel.

In affixing, the right or second transverse side 105 of the glass panel 102 is inserted into and further adhered by adhesives 40 to the air channels 122 and 127 of the respective front right upper and lower glass connectors 119 and 125. Therefore, the top end 121 of the front right upper glass connector is positioned lower than the upper lengthwise side 106 of the glass panel, and the bottom end 128 of the front right lower glass connector is positioned higher than the lower lengthwise side 108 of the glass panel. In this setting to attach to the glass panel, the front right upper and lower glass connectors 119 and 125 serve as the respective upper and lower position limiters in cooperation with the front right housing 180 to prevent the movement of the glass panel in the leftward transverse direction when sliding the glass panel 102 in the vertical direction.

Therefore, it will be appreciated that the glass panel 102 would have a very limited movement in the lengthwise direction when it is slid up or down under a control provided by the above disclosed upper and lower glass connectors incorporated with the respective front left and right housings. It will be further appreciated that the present invention can apply only one glass connector on each transverse side of the glass panel to achieve the same very limited transverse movement of the glass panel when it is in cooperation with the respective front left and right housings.

Figure 11:
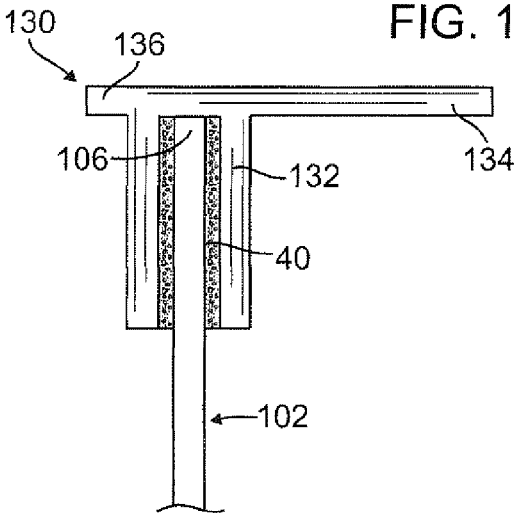
FIG. 11 is an elevational cross-sectional view of a top portion of the first slidable glass panel which is adjacent to an upper lengthwise side of the panel, wherein the glass panel is illustrated to be affixed by adhesives to an upper transverse handle.

As additionally illustrated in FIGS. 3, 6 and 11, the upper lengthwise handle 130 has a body, which includes a left end 131, a right end 133, a top and an inverted "U" shaped cross section containing a downward air channel 132 surrounded by a front side, and a rear side, wherein the upper lengthwise side 106 of the glass panel is inserted into and further adhered by adhesives 40 to the downward air channel 132. The body also includes a frontwardly extending top member 134 connected to the top of the body, which serves as a front handle to lift or lower the slidable glass panel 102 when a user stands outside of the bathtub. In addition, a rearwardly extending top member 136 connected to the top of the body, which serves as a connector to connect a lower handle of a middle glass panel 202 having an upwardly sliding movement, wherein the frontwardly and rearwardly extending members 134 and 136 are aligned together.

Figure 12:
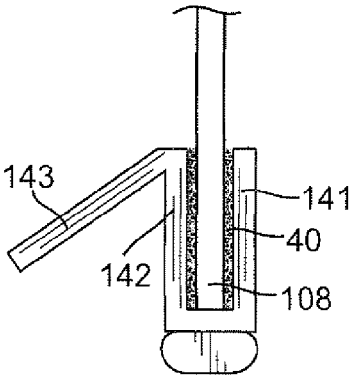
FIG. 12 is an elevational cross-sectional view of a bottom portion of the first slidable glass panel which is adjacent to a lower lengthwise side of the panel, wherein the glass panel is illustrated to be affixed by adhesives to a lower transverse handle, wherein a transverse flexible member (selected from the group consisting of vinyl, nylon and rubber) is affixed to a bottom of the handle.

Additionally referring to FIGS. 3, 6 and 12, the lower lengthwise handle 138 has a body, which includes a left end 139, a right end 140, and a "U" shaped cross section containing an upward air channel 141 surrounded by front side, and rear side 142, wherein the lower lengthwise side 108 of the glass panel is inserted into and further adhered by adhesives 40 to the upward air channel 141. In addition, a descending extending rear member 143 is connected to a top of the rear side 142 of the body, which serves as a rear handle for the user to lift or lower the front slidable glass panel 102, when the user is inside of the bathtub.

As illustrated in FIG. 3, there is an elongated lengthwise rubber member 145 attached to a bottom of the lower transverse handle 138. It will be appreciated that the flexible member 145 (selected from the group consisting of vinyl, nylon and rubber) serves as a watertight seal when the front glass panel 102 is lowered in contact with the top 32 of the bathtub 30.

Referring to FIGS. 3, 6 and 7, the front left housing 160 of the present invention is designed for positioning the front left pulley 146, with the left pulley axle 147 penetrating through a front left collar 148, front left cable 149, front left counterbalancing weight 155 at its top connected to a front left eye bolt 156, and left transverse side 104 of the front slidable glass panel 102 which is adhesively attached by the left lower glass connector 115 and upper glass connector 110 that at its top 112 having the left eye bolt 114.

It will be appreciated that FIGS. 3 and 7 illustrate that the front vertically slidable glass panel assembly 100 is completely assembled and further affixed to the left sidewall 26 as well as the right sidewall 28 of the bath room. In this setting as additionally illustrated in FIG. 6, the front left cable 149 is positioned to pass the top of the front left pulley 146, wherein its left end is connected to the front left counterbalancing weight 155 through the front left eye bolt 156, and its right end is connected to the eye bolt 114 affixed to the top of the left upper glass connector 110.

The front left housing 160 has a longitudinally elongated hollow body in a rectangularly shaped cross section, containing a top end 161, a bottom end 162, an elongated air space 163 surround by a front side 164, rear side 165, left side 166 and right side. A vertically elongated air gap cuts a middle of the right side which forms an elongated flat front member 167 and an elongated flat rear member 168, wherein the opened ends of the respective front and rear members 167 and 168 are covered with the respective front and rear rubber trims 169 and 170 (see FIG. 7). These two flexible trims (selected from the group consisting of vinyl, nylon and rubber) serve as the front left tracks having an elongated air gap 171 in between to provide smoothness for the left side 104 of the vertically slidable glass panel 102 in the vertically sliding movement, when the first vertically slidable glass panel assembly 100 is assembled and installed to the bathroom sidewalls.

In addition, a pair of the pulley axle holes 172 and 173 penetrate through the respective front and rear sides adjacent to the top 161 of the housing for positioning the left pulley axle 147, wherein the axle penetrates through a center of the front left collar 148 that penetrates through and further affixes to a center of the front left pulley 146. Therefore, the collar and pulley will have the same rotation around the pulley axle. Besides the pulley holes, a plurality of opening 174 are spaced apart to penetrate through the left side 166 of the housing for admitting fasteners such as screws when affixing the front left housing to the bathroom left sidewall in the installation of the assembly.

As illustrated in FIG. 6, the front right housing 180 of the present invention is symmetrically designed for positioning the front right pulley 150 penetrated by the front right collar 152 that is further penetrated by the right pulley axle 151, front right cable 153, front right counterbalancing weight 157 at its top connected to a front right eye bolt 158, and right transverse side 105 of the front slidable glass panel 102 which is adhesively attached by the left lower glass connector 125 and upper glass connector 119 that at its top 121 has the left eye bolt 123. The front right cable 153 is positioned to pass the top of the front right pulley 150, wherein its left end is connected to the front right counterbalancing weight 157 through the front right eye bolt 158, and its right end is connected to the eye bolt 123 affixed to the top of the right upper glass connector 119.

The front right housing 180 has a longitudinally elongated hollow body in a rectangularly shaped cross section, containing a top end 181, a bottom end 182, an elongated air space 183 surrounded by a front side 184, rear side 185, right side 186 and left side. A vertically elongated air gap 183 cuts a middle of the left side which forms an elongated flat front member 187 and an elongated flat rear member 188, wherein the opened ends of the respective front and rear members 187 and 188 are covered with the respective front and rear flexible trims 189 and 190 (selected from the group consisting of vinyl, nylon and rubber). Therefore it creates an elongated air gap 191 between the flexible trims, which serves as a track for the right side 105 of the vertically slidable glass panel 102 in the vertically sliding movement, when the first vertically slidable glass panel assembly 100 is assembled and attached to the right and left sidewalls 28 and 26 of the bathroom.

In addition, a pair of the pulley holes 192 and 193 penetrate through the respective front and rear sides adjacent to the top end 181 of the housing for positioning the right pulley axle 151, wherein the axle penetrates through a center of the front right collar 152 that penetrates through and further affixes to the center of the front left pulley 150. Therefore, the collar and pulley will have the same rotation around the pulley axle. Besides the pulley axle holes, a plurality of opening (not shown) are spaced apart to penetrate through the right side 186 of the housing for admitting fasteners such as screws when affixing the front right housing 180 to the bathroom right sidewall 28.

In this setting, it would be appreciated that a front or first counterbalancing weight system is completed and functional, which consists of a left counterbalancing weight connected to a left cable which passes a top of a left pulley penetrated by a left collar to thereby be capable of connecting to the left upper glass connector, and a right counterbalancing weight connected to a right cable which passes a top of a right pulley penetrated by a right collar to thereby be capable of connecting to the right upper glass connector.

It will be appreciated that all three vertically slidable glass assemblies 100, 200 and 300 have the similar structures including the similar parts and attachments, therefore for the purpose to reduce a length of this patent application, a disclosure of the parts and attachments of the respective middle and rear vertically slidable glass assemblies 200 or 300 will not repeated. These parts are designated with three-digit numerals, where in the part numbers are the same with the addition of a "200" or a "300" to the part numbers to differentiate those parts in the front vertically slidable glass assembly 100.

It will be further appreciated that, as illustrated in FIGS. 3 and 4, the rear upper lengthwise handle 330 of the rear vertically slidable glass panel 302 is slightly different from the front upper transverse handle 130 of the front vertically slidable glass panel 102, wherein the rear upper lengthwise handle 330 does not have the forwardly and rearwardly extending top members, as compared with the front upper lengthwise handle 130 that has the forwardly and rearwardly extending top members 134 and 136. In addition, the middle and rear lower transverse handles 240 and 340 contains the respective forwardly extending bottom members 244 and 344, which are different from the front lower lengthwise handle 138 that does not have a forwardly extending bottom member.

Referring to FIG. 7, there is illustrated the structural relationship of partial sections of the three vertically slidable glass panel assemblies 100, 200 and 300 after they are assembled together and further affixed to the left sidewall 26 of the bathroom by affixation from the fasteners such as screws to penetrate through the holes 174, 274 and 374 of the respective front, middle and rear left or front middle and rear first housings, wherein the partial of the three assemblies is adjacent to the left sidewall 26 of the bathroom. It would be appreciated that the three assemblies are also symmetrically affixed to the right side walls 28 of the bath room, which is illustrated by a right side view of FIG. 3.

In addition, FIGS. 1 and 2 provide the front views of the present invention vertically sliding enclosure when its installation is completed. As illustrated, the top ends 161 and 181 of the respective front left or front first and front right or front second housings 160 and 180 are positioned in contact with the ceiling 20 of the bathroom, and their respective bottom ends 162 and 182 are in contact with the top 32 of the bathtub 30.

In this setting as illustrated in FIG. 7, the air gaps 171, 272 and 372 are aligned in the backward direction of the respective front, middle and rear left housings 160, 260 and 360 of the respective front, middle and rear vertically slidable glass panel assemblies 100, 200 and 300. In addition, the rear side 165 of the front left housing 160 is attached to the front side 264 of the middle left side housing 260. The rear side 265 of the middle left side housing 260 is attached to the front side 364 of the rear left side housing 360.

The left pulley axle 147 is affixed to the tops 161, 261 and 261 of the respective left housings 160, 260 and 360 after penetrating through their respective pulley axle holes 172, 173, 272, 273, 372 and 373. In addition, the pulley axle 147 first penetrates through the front left collar 148 penetrating through the front left pulleys 146 wherein the collar 148 which is surrounded by the pulley 146 is positioned in the air space 163 of the housing 160. The pulley axle 147 then penetrates through the middle left collar 248 penetrating through the middle left pulleys 246 wherein the collar 248 which is surrounded by the pulley 246 is positioned in the air space 263 of the housing 260. The pulley axle 147 third penetrates through the rear left collar 348 penetrating through the rear left pulleys 346 wherein the collar 348 which is surrounded by the pulley 346 is positioned in the air space 363 of the housing 360.

In addition, the left transverse sides 104, 204 and 304 of the respective front, middle and rear glass panels 102, 202 and 302 attached by the respective front, middle and rear left upper glass connectors 110, 210 and 310, and the respective front, middle and rear lower glass connectors (not shown) are positioned insides of the respective left side housings 160, 260 and 360 when the glass panels 102, 202 and 302 extends rightwards to penetrate through the respective air gaps 171, 271 and 371 of the respective tracks.

As illustrated since the front, middle and rear left upper glass connectors 110, 210 and 310 are positioned insides of the respective left housings 160, 260 and 360, wherein their respective right sides 111, 211 and 311 of the bodies are positioned to align with and further are rightwardly adjacent to the respective flexible trims 169, 170, 269, 270, 369 and 370 (selected from the group consisting of vinyl, nylon and rubber). It will be appreciated that the front, middle and rear left lower glass connectors (not shown) of the respective three glass panels 102, 202 and 302 are also positioned to vertically align with the respective front, middle and rear left upper glass connectors 110, 210 and 310. Specifically their respective right sides of the bodies are vertically aligned with the respective right sides 111, 211 and 311 of the respective front, middle and rear left upper glass connectors 110, 210 and 310, and are further rightwardly adjacent to the respective flexible trims (selected from the group consisting of vinyl, nylon and rubber). In this setting, the front left upper and lower glass connectors 110 and 115 serve as the lengthwise position limiters for the front glass panel 102, the middle left upper and lower glass connectors 210 and 315 serve as the lengthwise position limiters for the middle glass panel 202, the rear left upper and lower glass connectors 310 and 315 serve as the lengthwise position limiters for the rear glass panel 302, wherein the lengthwise position limiters prevent the respective glass panels 102, 202 and 302 to have the respective rightward transverse movements in their respective vertically sliding movements.

It will be appreciated that since the right parts and right glass connectors are symmetrical to the left parts and left glass connectors which are disclosed above, especially from the disclosure of the partial of the respective front, middle and rear vertically slidable glass panel assemblies 100, 200 and 300 that are in their assembled form and further affixed to the left sidewall 26 in FIG. 7, the right parts and right glass connectors are well understood for the respective front, middle and rear vertically slidable glass panel assemblies 100, 200 and 300 that are in their assembled form and further affixed to the right sidewall 28, so that a disclosure similar to that of FIG. 7 will not be repeated for a purpose of reducing the length of this patent application. Therefore, the completely assembled embodiment 10 of the vertically sliding enclosure system is also well understood, which is illustrated in FIGS. 1 to 4.

In this situation, it will be appreciated that the left and right tracks formed by the respective front and rear flexible trims (selected from the group consisting of vinyl, nylon and rubber) for each assembly prevent the glass panel of the assembly from having forward or backward movement in its vertical movement. In addition, the left and right glass connectors of the glass panel prevent the left-right lengthwise movement in the cooperation with the tracks in plastics which additionally provide smoothness for the glass panel in the vertical movement.

Referring to FIGS. 1 and 3, there is illustrated that the top end 161 of the front left housing 160, and the top ends 181, 281 and 381 of the respective front, middle and rear right or front, middle and rear second housings 180, 280 and 380 are positioned to be in contact with the ceiling 20 of the bathroom, and their respective bottom ends 162, 182, 282 and 382 are in contact with the top 32 of the bathtub ledge.

In addition, it will be appreciated that for example, a weight of the front glass panel 102 having all of its attachments is balanced by a combined weight from the weight of the front left counterbalancing weight 155 having its eye bolt 156 that is combined with the weight of the front right counter balancing weight 157 having its eye bolt 158. Therefore, the front glass panel 102 can be vertically slid up and down by a hand force of the user of the bathtub that is applied onto either the frontwardly extending top member 134 or the descending extending rear member 143. The hand force is used to overcome a combined rotating friction force which is the friction force between the left pulley axle and rotating collar that is combined with the friction force between the right pulley axle and rotating collar. It will be appreciated that the combined rotating friction force is very small, especially in a situation where including lubricants in between the respective pulley axles and collars.

In contrast, the glass panel 102 can be physically stable at a position having the corresponding height after the hand force is withdrawn, since the presence of the stationary friction forces in between the respective pulley axles and collars makes the glass panel stable. Similarly these conditions are also available to the middle and rear glass panels 202 and 302. In this situation, the embodiment 10 of the vertically sliding enclosure can be workable as illustrated in FIGS. 1 to 4 according to the spirit and scope of the present invention.

It will be appreciated that in a preferred situation for the embodiment 10, each slidable glass panel has the same width of the transverse side, which is the height of the glass panel. Referring to FIGS. 1 and 3, there are illustrated when the front, middle and rear glass panels 102, 202 and 302 are slid down to their respective optimum lowered positions regarding their functions to the watertight seal inside of the bathtub, their respective individual heights "H2", "H3" and "H4" are combined in series to reach the highest position having a height "H6". Such height is just slightly lower than the height of a shower head 34 positioned to the left sidewall 24 of the bath room. In this situation, a height of a rectangular air space is "H5", wherein the air space is between the front rear glass panel 302 and ceiling 20. It would be appreciated that, the shower head 34 is usually positioned to be sufficiently higher than an average height for users having the regular body heights. Therefore, the highest position having the height "H6" where the present invention vertically sliding enclosure 10 can reach is adequate for the needs of users having a regular body height.

As illustrated in FIGS. 1 and 3 when the three glass panels are at their respective optimum lowered positions, the bottom flexible member 145 (selected from the group consisting of vinyl, nylon and rubber) of the front slidable glass panel 102, which serves as the watertight seal, is positioned in contact with the top 32 of the bathtub 30 having a height "H1" to thereby prevent the shower water from flowing out of the bathtub. In addition, the frontwardly extending bottom member 244 of the middle slidable glass panel 202 is positioned to be lower than but upwardly connected to the rearwardly extending top member 136 of the front slidable glass panel 102. Broadly specking regarding this condition, the present invention has the structural character that a bottom of the lower lengthwise handle of the middle glass panel is horizontally aligned with a top of the upper lengthwise handle of the front glass panel. Or a more broadly speaking, the bottom of the middle glass panel is horizontally aligned with a top of the front glass panel.

Similarly, the frontwardly extending bottom member 344 of the rear slidable glass panel 302 is positioned to be lower than but upwardly connected to the rearwardly extending top member 236 of the middle slidable glass panel 202. In a broad sense regarding this condition, the present invention has a structural character that a bottom of the lower lengthwise handle of the rear glass panel is horizontally aligned with a top of the upper lengthwise handle of the middle glass panel. Or in a more broad sense for the present invention, the bottom of the middle glass panel is horizontally aligned with a top of the front glass panel.

In this situation where the three glass panels have their respective optimum lower position, the three panels form a continuous wall to prevent the shower water to splash out of the bathtub when a user is in shower. Therefore, the present invention vertically sliding glass enclosure 10 has the same function as the existing bathtub enclosure, which can retain the shower water inside of the bathtub.

It will be appreciated that, although the three panels can provide the maximal height as illustrated in FIGS. 1 and 3, a user can have a choice to make the three glass panels be positioned lower than the height "H6" of the optimum position if it is necessary.

Referring to FIGS. 2 and 4, there is illustrated that the three panels are raised to their respective maximum heights. In this situation, it provides a sufficient height "H7" of an open space to enable the user to access the bathtub 30, wherein the height "H7" of a position is slightly lower than the height "H6" of the position in FIG. 1 due to the stack of the bottom transverse handles 138, 238 and 338 of the respective three panels. Therefore, it will be appreciated that such height is convenient and comfortable for users which have a regular body height.

As illustrated specifically in FIG. 4, a top of the upper lengthwise handle 330 of the rear slidable glass panel 302 is in contact with the ceiling 20. The frontwardly extending bottom member 344 of the lower lengthwise handle of the rear glass panel 302 is downwardly connected to the descending extending rear member 243 of the middle glass panel 202. Broadly stated, a bottom of the lower lengthwise handle or a bottom of the rear glass panel is horizontally aligned with a top of the lower lengthwise handle or a top of the middle glass. Furthermore, the frontwardly extending bottom member 244 of the middle glass panel is also downwardly connected to the descending extending rear member 143 of the front glass panel 102. This could also broadly disclose that a bottom of the lower lengthwise handle or a bottom of the middle glass panel is horizontally aligned with a top of the lower lengthwise handle or a top of the front glass panel. In this setting, a safety lock 60 is positioned into a safety lock hole 62 (see FIG. 3) for preventing the three glass panels from dropping down, wherein the bottom lengthwise flexible member 145 (selected from the group consisting of vinyl, nylon and rubber) of the front glass panel is positioned onto a top of the safety lock 60.

It will be appreciated that, under this situation the present invention vertically sliding enclosure is in a fully open position, which allows comfortable access to the bathtub when bathing children or oneself, cleaning the bathtub, and entering and exiting the bathtub.

The safety lock 60 could be in various forms. A simple one is a buttoned rod. Referring to FIG. 3 again, the safety hole 62 is positioned to penetrate through the right side 186 of the front right housing 180, and further in the plane that penetrate through the air gap 191 of the housing 180. It will be appreciated that such safety device including the safety lock and hole is necessary although each glass panel is physically stable after it is raised.

It will be appreciated that, although the above discloses the front left eye bolt 114 for connecting to the front left upper glass connector 110 and front left eye bolt 156 for connecting to the front left counterbalancing weight 155 are used as examples of the connecting means, such connecting means is not limited to two cranks. There can be any types of connecting means including holes of the respective glass connector and counter balancing weight.

It will be also appreciated that although the above illustration states that each glass panel has its counterbalancing weight system in the structure of the physical weight and pulley-pulley axle combination, a spring force to balance the weight of the glass panel is also well within the spirit and scope of the present invention.

In the configuration of applying a spring as the counterbalancing weight member, the spring can be a rolled spring operated through a pulley connected to the front left upper glass connector of the front glass panel. In this setting, if the panel is pulled down, a section of the spring is pulled out from a rolled section of the spring to thereby counterbalance the weight of the front panel. If the panel is raised up, a section of the spring is rolled back.

It will be appreciated that three vertically slidable panel assemblies are the preferred embodiment in the above disclosure containing three slidable panels, but at least three or more than three slidable panel assemblies having the respective at least three or more than three slidable panels also can be used and are within the spirit and scope of the present invention.

It will be further appreciated that referring to FIG. 5 as compared with the first embodiment 10 of the present invention disclosed above, the second embodiment 12 has a length of the housings that is longer than that of the first embodiment as well as the third embodiment 14. In addition, the second and third embodiments also can have at least three or more than three panels.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A sliding enclosure for a bathtub/shower combination surrounded by a rear wall, and left and right sidewalls of a bathroom, comprising:

a. front, middle and rear identical slidable glass panel assemblies including the respective front, middle and rear glass panels attached by respective attachments, each assembly including a counterbalancing weight system, left and right pulley axles, and left and right housings;

b. each of said slidable glass panels being rectangular in shape having a left transverse side, a right transverse side, an upper lengthwise side and a lower lengthwise side, each of said attachments including an left upper glass connector at its top having a left eye bolt and a lower glass connector which is attached to the left transverse side of the glass panel, a right upper glass connector at its top connected to a right eye bolt and a lower glass connector which is attached to the right transverse side of the glass panel, an upper lengthwise handle attached to the upper lengthwise side of each of the glass panels and a lower lengthwise handle attached to the lower lengthwise side of each of the glass panels, wherein:

i. an upper lengthwise handle of the rear glass panel having a body that includes a left end, a right end, a top and an inverted "U" shaped cross section containing a downward air channel surrounded by a front side, and a rear side, an upper lengthwise side of the rear glass panel is inserted into and further adhered by adhesives to the downward air channel, a lower lengthwise handle of the rear glass panel having a body that includes a left end, a right end, a bottom and an "U" shaped cross section containing an upward air channel surrounded by a front side and a rear side, a lower lengthwise side of the rear glass panel is inserted into and further adhered by adhesives to the upward air channel, a descending extending rear member connected to a top of the rear side of the body which serves as a rear handle for a user to lift or lower the rear slidable glass panel, and a forwardly extending member connected to the bottom of the body;

ii. an upper lengthwise handle of the middle glass panel having a body that includes a left end, a right end, a top and an inverted "U" shaped cross section containing a downward air channel surrounded by a front side, and a rear side, wherein an upper lengthwise side of the middle glass panel is inserted into and further adhered by adhesives to the downward air channel, a forwardly extending member connected to the top of the body and a rearwardly extending member connected to the top of the body wherein the members are aligned together and the frontwardly extending member serving as a front handle for the user to lift or lower the middle slidable glass panel, a lower lengthwise handle of the middle glass panel having a body that includes a left end, a right end, a bottom and an "U" shaped cross section containing an upward air channel surrounded by a front side and a rear side, wherein a lower lengthwise side of the middle glass panel is inserted into and further adhered by adhesives to the upward air channel, a descending extending rear member connected to a top of the rear side of the body which serves as a rear handle for the user to lift or lower the middle slidable glass panel, and a forwardly extending member connected to the bottom of the body of the lower lengthwise handle;

iii. an upper lengthwise handle of the front glass panel having a body that includes a left end, a right end, a top and an inverted "U" shaped cross section containing a downward air channel surrounded by a front side, and a rear side, wherein an upper lengthwise side of the front glass panel is inserted into and further adhered by adhesives to the downward air channel, a forwardly extending member connected to the top of the body and a rearwardly extending member connected to the top of the body wherein the members are aligned together and the frontwardly extending member serving as a front handle for the user to lift or lower the front slidable glass panel, a lower lengthwise handle of the front glass panel having a body, wherein the body includes a left end, a right end, a bottom and a "U" shaped cross section containing an upward air channel surrounded by a front side and a rear side, wherein a lower lengthwise side of the front glass panel is inserted into and further adhered by adhesives to the upward air channel, a descending extending rear member connected to a top of the rear side of the body which serves as a rear handle for the user to lift or lower the front slidable glass panel, a flexible member selected from the group consisting of vinyl, nylon and rubber attached to the bottom of the body of the lower lengthwise handle of the front glass panel;

c. said counterbalancing weight system including left and right structures, the left structure including a left counterbalancing weight at its top connected to a left eye bolt that is connected to a left end of a left cable that passes over a top of a left pulley penetrated by a left collar and is connected to the left eye bolt connected to the left upper glass connector at a right end of the left cable, the right structure including a right counterbalancing weight at its top connected to a right eye bolt that is connected to a right end of a right cable that passes over a top of a right pulley penetrated by a right collar and is connected to the right eye bolt connected to the right upper glass connector at a left end of the right cable;

d. the left housing having a longitudinally elongated hollow body in a rectangularly shaped cross section, containing a top end, a bottom end, an elongated air space surround by a front side having a pulley axle opening adjacent to the top end, a rear side having a pulley axle opening adjacent to the top end, a left side having a plurality of openings and a right side, a vertically elongated gap of opening cuts a middle of the right side which forms an elongated flat front member having an opened end covered with a front flexible trim and an elongated flat rear member having an opened end covered with a rear rubber trim, wherein there is an elongated rightward air gap between the two flexible trims, the right housing is a mirror image of the left housing, including a longitudinally elongated hollow body in a rectangularly shaped cross section, containing a top end, a bottom end, an elongated air space surrounded by a front side having a pulley axle opening adjacent to the top end, a rear side having a pulley axle opening adjacent to the top end, a right side having a plurality of openings and a left side, a vertically elongated gap of opening cuts a middle of the left side which forms an elongated flat front member having an opened end covered with a front flexible trim and an elongated flat rear member having an opened end covered with a rear flexible trim, wherein there is an elongated leftward air gap between the two flexible trims;

e. said each assembly is assembled, wherein the left housing is affixed to the left sidewall of the bathroom by affixation from a plurality of fasteners penetrating through the openings of the left side of the left housing and the bottom end of the left housing is in contact with a top of a ledge of the bathtub, the left pulley axle penetrating through the pulley axle openings of the respective front and rear sides of the left housing, the left pulley axle further penetrating through the left collar surrounded by the left pulley that is positioned inside of the left housing and has the left cable at the left end connected to the left upper glass connector, the right housing is affixed to the right sidewall of the bathroom by affixation from a plurality of fasteners penetrating through the openings of the right side of the right housing and the bottom end of the left housing is in contact with the top of the ledge of the bathtub, the right pulley axle penetrating through the pulley axle openings of the respective front and rear sides of the right housing, the right pulley axle further penetrating through the right collar surrounded by the right pulley that is positioned inside of the right housing and has the right cable at the left end connected to the left upper glass connector, the left transverse side of the glass panel attached by the upper and lower glass connectors is positioned inside of the left housing, wherein the glass panel penetrating through the elongated rightward air gap and extending rightwardly, the right transverse side of the glass panel attached by the upper and lower glass connectors is positioned inside of the right housing, wherein the glass panel penetrates through the elongated leftward air gap and extending leftwardly;

f. said front, middle and rear identical slidable glass panel assemblies are assembled together, so that the front, middle and rear left housings of the respective front, middle and rear identical slidable glass panel assemblies are connected to one another wherein their respective elongated rightward air gaps are aligned in a front-rear direction, front, middle and rear right housings of the respective said front, middle and rear identical slidable glass panel assemblies are connected to one another wherein their respective elongated leftward air gaps are aligned in the same front-rear direction; and g. the sliding enclosure prevents shower water from flowing out of the bathtub for the user in use of the bathtub/shower combination when front, middle and rear glass panels of the respective front, middle and rear slidable glass assemblies are slid down to their respective lowered positions wherein a bottom of the flexible member is in contact with a top of a ledge of the bathtub, the rearwardly extending member of the front glass panel is positioned higher than and downwardly connected to the frontwardly extending member of the lower lengthwise handle of the middle glass panel, the rearwardly extending member of the middle glass panel is positioned higher than and downwardly connected to the frontwardly extending member of the rear glass panel, so that the three panels are connected to one another to thereby form a continuous wall to prevent splashing of the shower water out of the bathtub/shower combination;

h. whereby the sliding enclosure provides an open space to enable the user to access the bathtub when the front, middle and rear glass panels are raised up wherein a top of an upper lengthwise handle of the rear glass panel is in contact with the ceiling of the bathroom, the bottom of the lower lengthwise handle of the rear glass panel is horizontally aligned with a top of the lower lengthwise handle of the middle glass panel, and the bottom of the lower lengthwise handle of the middle glass panel is horizontally aligned with a top of the lower lengthwise handle of the front glass panel.

2. The sliding enclosure in accordance with claim 1, further comprising a safety lock, and a safety lock hole penetrating through a right side of the front right housing.

3. The sliding enclosure in accordance with claim 2, further comprising when the front, middle and rear glass panels are raised, then the bottom of the flexible member is positioned to a top of the safety lock positioned to the safety lock hole.

4. The sliding enclosure in accordance with claim 1, wherein tops of the respective front, middle and rear left housings and tops of the respective front, middle and rear right housings of the enclosure are in contact with the ceiling of the bathroom.

5. The sliding enclosure in accordance with claim 1, wherein tops of the respective front, middle and rear left housings and tops of the respective front, middle and rear right housings of the enclosure are positioned lower than the ceiling of the bathroom.

6. The sliding enclosure in accordance with claim 1, further comprising a pocket of the ceiling wherein tops of the respective front, middle and rear left housings and tops of the respective front, middle and rear right housings of the enclosure are positioned inside of the pocket of the bathroom.

7. The sliding enclosure in accordance with claim 1, further comprising at least three slidable glass assemblies.

8. The sliding enclosure in accordance with claim 1, wherein each assembly includes a counterbalancing force system to balance a weight of each glass panel attached with attachments.

9. The sliding enclosure in accordance with claim 1, wherein each glass panel is made of a code-compliant tempered glass selected from the group consisting of clear glass and translucent glass.

10. A sliding enclosure for a bathtub/shower combination surrounded by a rear wall, and left and right sidewalls of a bathroom, comprising:

a. front, middle and rear identical slidable panel assemblies including the respective front, middle and rear glass panels attached by the respective attachments, each assembly including a counterbalancing weight system, left and right pulley axles, and left and right housings;

b. each of said slidable panels having a left transverse side, a right transverse side, an upper lengthwise side and a lower lengthwise side, each of said attachments including left upper and lower connectors attached to the left transverse side, right upper and lower connectors attached to the right transverse side, upper lengthwise handle attached to the upper lengthwise side and a lower lengthwise handle attached to the lower lengthwise side, wherein:

i. an upper lengthwise handle of the rear glass panel having a body that includes a left end, a right end, a top and an inverted "U" shaped cross section containing a downward air channel surrounded by a front side, and a rear side, an upper lengthwise side of the rear glass panel is inserted into and further adhered by adhesives to the downward air channel, a lower lengthwise handle of the rear glass panel having a body that includes a left end, a right end, a bottom and an "U" shaped cross section containing an upward air channel surrounded by a front side and a rear side, a lower lengthwise side of the rear glass panel is inserted into and further adhered by adhesives to the upward air channel, a descending extending rear member connected to a top of the rear side of the body which serves as a rear handle for a user to lift or lower the rear slidable glass panel, and a forwardly extending member connected to the bottom of the body;

ii. an upper lengthwise handle of the middle glass panel having a body that includes a left end, a right end, a top and an inverted "U" shaped cross section containing a downward air channel surrounded by a front side, and a rear side, wherein an upper lengthwise side of the middle glass panel is inserted into and further adhered by adhesives to the downward air channel, a forwardly extending member connected to the top of the body and a rearwardly extending member connected to the top of the body wherein the members are aligned together and the frontwardly extending member serving as a front handle for the user to lift or lower the middle slidable glass panel, a lower lengthwise handle of the middle glass panel having a body that includes a left end, a right end, a bottom and an "U" shaped cross section containing an upward air channel surrounded by a front side and a rear side, wherein a lower lengthwise side of the middle glass panel is inserted into and further adhered by adhesives to the upward air channel, a descending extending rear member connected to a top of the rear side of the body which serves as a rear handle for the user to lift or lower the middle slidable glass panel, and a forwardly extending member connected to the bottom of the body of the lower lengthwise handle;

iii. an upper lengthwise handle of the front glass panel having a body that includes a left end, a right end, a top and an inverted "U" shaped cross section containing a downward air channel surrounded by a front side, and a rear side, wherein an upper lengthwise side of the front glass panel is inserted into and further adhered by adhesives to the downward air channel, a forwardly extending member connected to the top of the body and a rearwardly extending member connected to the top of the body wherein the members are aligned together and the frontwardly extending member serving as a front handle for the user to lift or lower the front slidable glass panel, a lower lengthwise handle of the front glass panel having a body, wherein the body includes a left end, a right end, a bottom and a "U" shaped cross section containing an upward air channel surrounded by a front side and a rear side, wherein a lower lengthwise side of the front glass panel is inserted into and further adhered by adhesives to the upward air channel, a descending extending rear member connected to a top of the rear side of the body which serves as a rear handle for the user to lift or lower the front slidable glass panel, a flexible member attached to the bottom of the body of the lower lengthwise handle of the front glass panel;

c. said counterbalancing weight system including left and right structures, the left structure including a left counterbalancing weight connected to a left end of a left cable that passes over a top of a left pulley penetrated by a left collar and is connected to said left upper glass connector at a right end of the left cable, the right structure including a right counterbalancing weight connected to a right end of a right cable that passes over a top of a right pulley penetrated by a right collar and is connected to said right upper glass connector at a left end of the right cable;

d. the front left housing having a longitudinally elongated hollow body containing a top end, a bottom end, an elongated air space surround by a front side having a pulley axle opening adjacent to the top end, a rear side having a pulley axle opening adjacent to the top end, a left side having a plurality of openings and a right side, a vertically elongated gap of opening cuts a middle of the right side which forms an elongated flat front member having an opened end covered with a front flexible trim and an elongated flat rear member having an opened end covered with a rear flexible trim, wherein there is an elongated rightward air gap between the two flexible trims, the right housing is a mirror image of the left housing, including a longitudinally elongated hollow body containing a top end, a bottom end, an elongated air space surrounded by a front side having a pulley axle opening adjacent to the top end, a rear side having a pulley axle opening adjacent to the top end, a right side having a plurality of openings and a left side, a vertically elongated gap of opening cuts a middle of the left side which forms an elongated flat front member having an opened end covered with a front flexible trim and an elongated flat rear member having an opened end covered with a rear flexible trim, wherein there is an elongated leftward air gap between the two flexible trims;

e. said each assembly is assembled, wherein the left housing is affixed to the left sidewall of the bathroom and the bottom end of the left housing is in contact with a top of a ledge of the bathtub, the left pulley axle penetrating through the pulley axle openings of the respective front and rear sides of the left housing, the left pulley axle further penetrating through the left collar surrounded by the left pulley that is positioned inside of the left housing and has the left cable at the left end connected to the left upper connector, the right housing is affixed to the right sidewall of the bathroom and the bottom end of the left housing is in contact with the top of the ledge of the bathtub, the right pulley axle penetrating through the pulley axle openings of the respective front and rear sides of the right housing, the right pulley axle further penetrating through the right collar surrounded by the right pulley that is positioned inside of the right housing and has the right cable at the left end connected to the left upper glass connector, the left transverse side of the glass panel attached by the upper and lower connectors are positioned inside of the left housing, wherein the panel penetrating through the elongated rightward air gap and extending rightwardly, the right transverse side of the glass panel attached by the upper and lower connectors are positioned inside of the right housing, wherein the panel penetrates through the elongated leftward air gap and extending leftwardly;

f. said front, middle and rear identical slidable panel assemblies are assembled together, the front, middle and rear left housings are connected to one another wherein their respective elongated rightward air gaps are aligned in a front-rear direction, the front, middle and rear right housings are connected to one another wherein their respective elongated leftward air gaps are aligned in the same front-rear direction; and g. the sliding enclosure preventing a shower water from flowing out of the bathtub for the user in use of the bathtub/shower combination when the front, middle and rear panels are slid down to their respective lowered positions wherein a bottom of the flexible member is in contact with a top of a ledge of the bathtub, the rearwardly extending member of the front glass panel is positioned higher than and downwardly connected to the frontwardly extending member of the lower lengthwise handle of the middle glass panel, the rearwardly extending member of the middle glass panel is positioned higher than and downwardly connected to the frontwardly extending member of the rear glass panel, so that the three panels are connected to one another to thereby form a continuous wall to prevent splashing of the shower water out of the bathtub/shower combination; and h. the sliding enclosure provides a height of an open space to enable the user to access the bathtub when the front, middle and rear glass panels are raised up wherein the height of the open space is higher than a regular body height of the user.

11. The sliding enclosure in accordance with claim 10, wherein each slidable panel is made of a code-compliant tempered glass selected from the group consisting of clear glass and translucent glass.

12. The sliding enclosure in accordance with claim 10, further comprising at least three slidable glass assemblies.

13. A sliding enclosure for a bathtub/shower combination surrounded by a rear wall, and left and right sidewalls of a bathroom, comprising:

a. front, middle and rear identical slidable panel assemblies including the respective front, middle and rear glass panels attached by the respective attachments, each assembly including a counterbalancing weight system, left and right pulley axles, and left and right housings;

b. each of said slidable panels having a left transverse side, a right transverse side, an upper lengthwise side and a lower lengthwise side, each of said attachments including left connector attached to the left transverse side, right connector attached to the right transverse side, an upper lengthwise handle attached to the upper lengthwise side and a lower lengthwise handle attached to the lower lengthwise side, wherein i. an upper lengthwise handle of the rear glass panel having a body that includes a downward air channel connected to the rear glass panel, a lower lengthwise handle of the rear glass panel having a body that includes a bottom and an upward air channel connected to the rear glass panel, a descending extending rear member connected to a top of the body of the lower lengthwise handle which serves as a rear handle for a user to lift or lower the rear slidable glass panel, and a forwardly extending member connected to the bottom of the body of the lower lengthwise handle;

ii. an upper lengthwise handle of the middle glass panel having a body that includes a top and a downward air channel connected to the middle glass panel, a forwardly extending member connected to the top of the body and a rearwardly extending member connected to the top of the body wherein the frontwardly extending member serving as a front handle for the user to lift or lower the middle slidable glass panel, a lower lengthwise handle of the middle glass panel having a body that includes a bottom and an upward air channel connected to the middle glass panel, a descending extending rear member connected to the top of the body of the lower lengthwise handle which serves as a rear handle for the user to lift or lower the middle slidable glass panel, and a forwardly extending member connected to the bottom of the body of the lower lengthwise handle;

iii. an upper lengthwise handle of the front glass panel having a body that includes a top and a downward air channel connected to the front glass panel, a forwardly member ember connected to the top of the body and a rearwardly extending member connected to the top of the body wherein the frontwardly extending member serving as a front handle for the user to lift or lower the front slidable glass panel, a lower lengthwise handle of the front glass panel having a body that includes a bottom and an upward air channel connected to the front glass panel, a descending extending rear member connected to a top of the body of the lower lengthwise handle which serves as a rear handle for the user to lift or lower the front slidable glass panel, a flexible member attached to the bottom of the body of the lower lengthwise handle of the front glass panel;

c. said counterbalancing weight system including left and right structures, the left structure including a left counterbalancing weight connected to a left end of a left cable that passes over a top of a left pulley penetrated by a left collar and is capable of connecting to said left upper glass connector at a right end of the left cable, the right structure including a right counterbalancing weight connected to a right end of a right cable that passes over a top of a right pulley penetrated by a right collar and is capable of connecting to said right upper glass connector at a left end of the right cable;

d. the front left housing having a longitudinally elongated hollow body containing a top end, a bottom end, an elongated air space surround by a front side having a pulley axle opening adjacent to the top end, a rear side having a pulley axle opening adjacent to the top end, a left side having a plurality of openings and a right side having front and rear flexible trims wherein there is an elongated rightward air gap cutting the right side and being positioned between the two flexible trims, the right housing is a mirror image of the left housing, including a longitudinally elongated hollow body containing a top end, a bottom end, an elongated air space surround by a front side having a pulley axle opening adjacent to the top end, a rear side having a pulley axle opening adjacent to the top end, a right side having a plurality of openings and a left side having front and rear rubber trims wherein there is an elongated leftward air gap cutting the left side and being positioned between the two flexible trims;

e. said each assembly is assembled, wherein the left housing is affixed to the left sidewall of the bathroom and the bottom end of the left housing is in contact with a top of a ledge of the bathtub, the left pulley axle penetrating through the pulley axle openings of the respective front and rear sides of the left housing, the left pulley axle further penetrating through the left collar surrounded by the left pulley that is positioned inside of the left housing and has the left cable at the left end connected to the left upper connector, the right housing is affixed to the right sidewall of the bathroom and the bottom end of the left housing is in contact with the top of the ledge of the bathtub, the right pulley axle penetrating through the pulley axle openings of the respective front and rear sides of the right housing, the right pulley axle further penetrating through the right collar surrounded by the right pulley that is positioned inside of the right housing and has the right cable at the left end connected to the left upper glass connector, the left transverse side of the glass panel attached by the connector is positioned inside of the left housing, wherein the panel penetrates through the elongated rightward air gap and extends in a rightward direction, the right transverse side of the glass panel attached by the connector is positioned inside of the right housing, wherein the panel penetrates through the elongated leftward air gap and extends in a leftward direction; and f. said front, middle and rear identical slidable panel assemblies are assembled together, the front, middle and rear left housings are connected to one another wherein their respective elongated rightward air gaps are aligned in a front-rear direction, the front, middle and rear right housings are connected to one another wherein their respective elongated leftward air gaps are aligned in the same front-rear direction;

g. whereby the sliding enclosure prevents shower water from flowing out of the bathtub for the user in use of the bathtub/shower combination when the front, middle and rear panels are slid down to their respective lowered positions wherein a bottom of the flexible member is in contact with a top of a ledge of the bathtub, the rearwardly extending member of the front glass panel is positioned higher than and downwardly connected to the frontwardly extending member of the lower lengthwise handle of the middle glass panel, the rearwardly extending member of the middle glass panel is positioned higher than and downwardly connected to the frontwardly extending member of the rear glass panel, so that the three panels are connected to one another to thereby form a continuous wall to prevent splashing of the shower water out of the bathtub/shower combination; and h. the sliding enclosure provides an open space to enable the user to access the bathtub when the front, middle and rear glass panels are raised up wherein the height of the open space is higher than a regular body height of the user.

14. The sliding enclosure in accordance with claim 13, further comprising at least three slidable glass assemblies.

15. The sliding enclosure in accordance with claim 13, wherein each slidable panel is made of material selected from the group consisting of translucent plastic and clear plastic.

16. A vertical sliding enclosure for a bathtub, comprising:

a. three vertically slidable glass panel assemblies having the respective front, middle and rear slidable glass panels attached by the respective left and right glass connectors serving as transverse position limiters which limit transverse movement of each of the three vertically slidable glass panels, panels, wherein;

i. an upper lengthwise handle of the rear glass panel having a body connected to the rear glass panel, a lower lengthwise handle of the rear glass panel having a body connected to the rear glass panel, and a forwardly extending member connected to the body of the lower lengthwise handle;

ii. an upper lengthwise handle of the middle glass panel having a body connected to the middle glass panel, a rearwardly extending member connected to the body, a lower lengthwise handle of the middle glass panel having a body connected to the middle glass panel, and a forwardly extending member connected to the body of the lower lengthwise handle;

iii. an upper lengthwise handle of the front glass panel having a body connected to the front glass panel, a forwardly extending member connected to the body and a rearwardly extending member connected to the body, a lower lengthwise handle of the front glass panel having a body connected to the front glass panel, a descending extending rear member connected to the body of the lower lengthwise handle, a flexible member attached to the bottom of the body of the lower lengthwise handle of the front glass panel;

b. a pair of left and right housings each respectively having longitudinal tracks to facilitate vertical movement of each panel and further including space for a counterbalancing weight system containing left and right pulleys and weight combinations so that a weight of the glass panel is counter-balanced;

c. an enclosure which provides sufficient height for a user to access the bathtub when the three panels are raised to their maximum heights; and d. when the three panels are in a lowered position, a bottom of the flexible member is in contact with a top of a ledge of the bathtub, the rearwardly extending member of the front glass panel is positioned higher than and downwardly connected to the frontwardly extending member of the lower lengthwise handle of the middle glass panel, the rearwardly extending member of the middle glass panel is positioned higher than and downwardly connected to the frontwardly extending member of the rear glass panel, so that the three panels are connected to one another to thereby form a continuous wall to prevent splashing of the shower water out of the bathtub/shower combination.

17. The vertical enclosure for a bathtub in accordance with claim 16, further comprising: each vertically slidable glass panel includes at least one handle by which the glass panel is raised and lowered.

18. The vertical enclosure for a bathtub in accordance with claim 10, wherein the flexible member is selected from the group consisting of vinyl, nylon and rubber.

19. The vertical enclosure for a bathtub in accordance with claim 10, wherein each slidable glass panel is adhered by adhesives to the respective upper and lower lengthwise handles.

20. The vertical enclosure for a bathtub in accordance with claim 13, wherein the flexible member is selected from the group consisting of vinyl, nylon and rubber.

21. The vertical enclosure for a bathtub in accordance with claim 13, wherein each slidable glass panel is adhered by adhesives to the respective upper and lower lengthwise handles.

22. The vertical enclosure for a bathtub in accordance with claim 16, wherein the flexible member is selected from the group consisting of vinyl, nylon and rubber.

23. The vertical enclosure for a bathtub in accordance with claim 16, wherein a descending extending rear member connected to a the body of the lower lengthwise handle of the rear slidable glass panel which is served as a front handle for a user to lift or lower the rear slidable glass panel, a forwardly extending member connected to the body of the upper lengthwise handle of the middle slidable glass panel which is served as a front handle for the user to lift or lower the middle slidable glass panel, and a descending extending rear member connected to the body of the lower lengthwise handle of the middle slidable glass panel which is served as a rear handle for the user to lift or lower the middle slidable glass panel, a forwardly extending member connected to the body of the upper lengthwise handle of the front slidable glass panel which is served as a front handle for the user to lift or lower the front slidable glass panel, and a descending extending rear member connected to the body of the lower lengthwise handle of the front slidable glass panel which is served as a rear handle for the user to lift or lower the front slidable glass panel.

* * * * *